US007007678B2

(12) United States Patent
Schultz et al.

(10) Patent No.: US 7,007,678 B2
(45) Date of Patent: Mar. 7, 2006

(54) IN-TANK FUEL FILTER

(75) Inventors: Jason Schultz, Belleville, MI (US); David Zultowski, Canton, MI (US); Kevin Reising, West Bloomfield, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 86 days.

(21) Appl. No.: 10/623,642

(22) Filed: Jul. 21, 2003

(65) Prior Publication Data

US 2005/0016506 A1 Jan. 27, 2005

(51) Int. Cl.
*F02M 37/04* (2006.01)

(52) U.S. Cl. ..... 123/509; 123/510

(58) Field of Classification Search ..... 123/509, 123/514, 516, 518; 210/777, 115; 137/565.35
See application file for complete search history.

(56) References Cited

U.S. PATENT DOCUMENTS

| | | | | |
|---|---|---|---|---|
| 4,919,103 A | | 4/1990 | Ishiguro et al. | 123/514 |
| 5,080,077 A | * | 1/1992 | Sawert et al. | 123/514 |
| 5,392,750 A | * | 2/1995 | Laue et al. | 123/509 |
| 5,900,148 A | | 5/1999 | Izutani et al. | 210/416.4 |
| 6,076,509 A | * | 6/2000 | Kyuma | 123/516 |
| 6,196,200 B1 | | 3/2001 | Roche et al. | 123/509 |
| 6,213,143 B1 | | 4/2001 | Schwegler et al. | 137/115.27 |
| 6,220,227 B1 | * | 4/2001 | Okada et al. | 123/509 |
| 6,230,691 B1 | | 5/2001 | Coha et al. | 123/514 |
| 6,264,831 B1 | | 7/2001 | Hawkins et al. | 210/86 |
| 6,279,541 B1 | * | 8/2001 | Doane et al. | 123/497 |
| 6,293,770 B1 | * | 9/2001 | Matsumoto et al. | 417/361 |
| 6,305,417 B1 | * | 10/2001 | Kleppner et al. | 137/565.34 |
| 6,328,063 B1 | * | 12/2001 | Tistchenko | 137/565.22 |
| 6,412,475 B1 | * | 7/2002 | Joos et al. | 123/510 |
| 6,453,870 B1 | * | 9/2002 | Koller et al. | 123/198 E |
| 6,606,980 B1 | * | 8/2003 | Walter | 123/509 |
| 6,619,272 B1 | * | 9/2003 | Jones et al. | 123/514 |

* cited by examiner

*Primary Examiner*—Henry C. Yuen
*Assistant Examiner*—Jason Benton
(74) *Attorney, Agent, or Firm*—Brinks Hofer Gilson & Lione

(57) ABSTRACT

A fuel supply system and fuel filter for a vehicle prevent bleed down of the fuel filter and minimizes the amount of any air or vapor delivered to the fuel supply line. The fuel filter includes a housing enclosing a filter media. The filter includes an inlet for receiving fuel from the fuel pump. The filter also includes first and second outlets. The first outlet supplies filtered fuel to the fuel supply line. The second outlet supplies filtered fuel to the jet pump. In this way, by providing a single outlet from the fuel pump to the fuel filter, and providing two outlets from the fuel filter which separately leads to the fuel supply line and the jet pump, bleed down is prevented and vapors within the fuel supply line are reduced.

16 Claims, 5 Drawing Sheets

IN-TANK FUEL FILTER

FIELD OF THE INVENTION

The present invention relates generally to fuel filters, and more particularly relates to fuel filters internalized within the fuel tank and incorporated into a fuel delivery module.

BACKGROUND OF THE INVENTION

The fuel supply system of a vehicle typically includes a fuel tank having a fuel pump therein for providing fuel to the engine via a fuel supply line. Typically, the fuel pump forms a portion of a fuel delivery module which includes a reservoir for collecting fluid from the tank for supplying the engine. An outlet of the fuel pump is linked to a manifold on the exterior of the fuel delivery module. The manifold diverts some fuel to the engine and some fuel to a jet pump. The jet pump includes a nozzle which sprays fuel into an internal standpipe, thereby creating a vacuum and drawing in fuel off the bottom of the tank. As is known, the jet pump allows fuel to be sucked from the bottom of the fuel tank when fuel levels are low.

A fuel filter is typically connected to the fuel supply line for filtering fuel flowing to the engine from the fuel pump. Unfortunately, when the vehicle is turned off, the fuel in the filter tends to bleed down back into the tank via the manifold and jet pump. In turn, the lack of fuel in the filter causes a hard start and/or a long crank issue with the vehicle. More specifically, the fuel filter must be replenished with fuel before the fuel supply line is pressurized and fuel is delivered to the engine. Furthermore, any air or vapor in the filter may also be delivered to the fuel supply line.

Accordingly, there exists a need to provide a fuel supply system having a fuel filter which does not bleed down into the tank when the vehicle is turned off, and which minimizes or eliminates any air or vapor delivered to the fuel supply line.

BRIEF SUMMARY OF THE INVENTION

The present invention provides a fuel supply system for a vehicle which prevents bleed-down of the fuel filter and minimizes the amount of any air or vapor delivered to the fuel supply line. The system generally includes a fuel tank, a fuel delivery module, a fuel supply line and a jet pump. The fuel delivery module has a reservoir and a fuel pump pressurizing fuel from the reservoir. The fuel supply line leads from the fuel tank to the engine of the vehicle. The jet pump collects fuel from the bottom of the fuel tank and supplies the collected fuel to the reservoir of the fuel delivery module. The filter includes a housing enclosing a filter media. The filter includes an inlet for receiving fuel from the fuel pump. The filter also includes first and second outlets. The first outlet supplies filtered fuel to the fuel supply line. The second outlet supplies filtered fuel to the jet pump. In this way, by providing a single inlet from the fuel pump to the fuel filter, and by providing two distinct outlets from the fuel filter which separately lead to the fuel supply line and the jet pump, bleed down is prevented and vapors within the fuel supply line are reduced.

According to more detailed aspects, the second outlet preferably includes a standpipe having a receiving end position within the top half of the filter housing. When the receiving end is positioned adjacent the top of the filter housing, fuel is prevented from leaking down into the tank through the jet pump. Additionally, any air or vapors which do collect within the filter will rise to the top of the filter, and will be purged through the jet pump upon start-up. The first outlet also preferably includes a standpipe having its receiving end positioned within the bottom half of the filter housing. By positioning the first outlet's receiving end adjacent the bottom of the filter housing, a continuous supply of fuel is available to the engine.

BRIEF DESCRIPTION OF THE DRAWINGS

The accompanying drawings incorporated in and forming a part of the specification illustrate several aspects of the present invention, and together with the description serve to explain the principles of the invention. In the drawings.

DETAILED DESCRIPTION OF THE INVENTION

Figure 1:
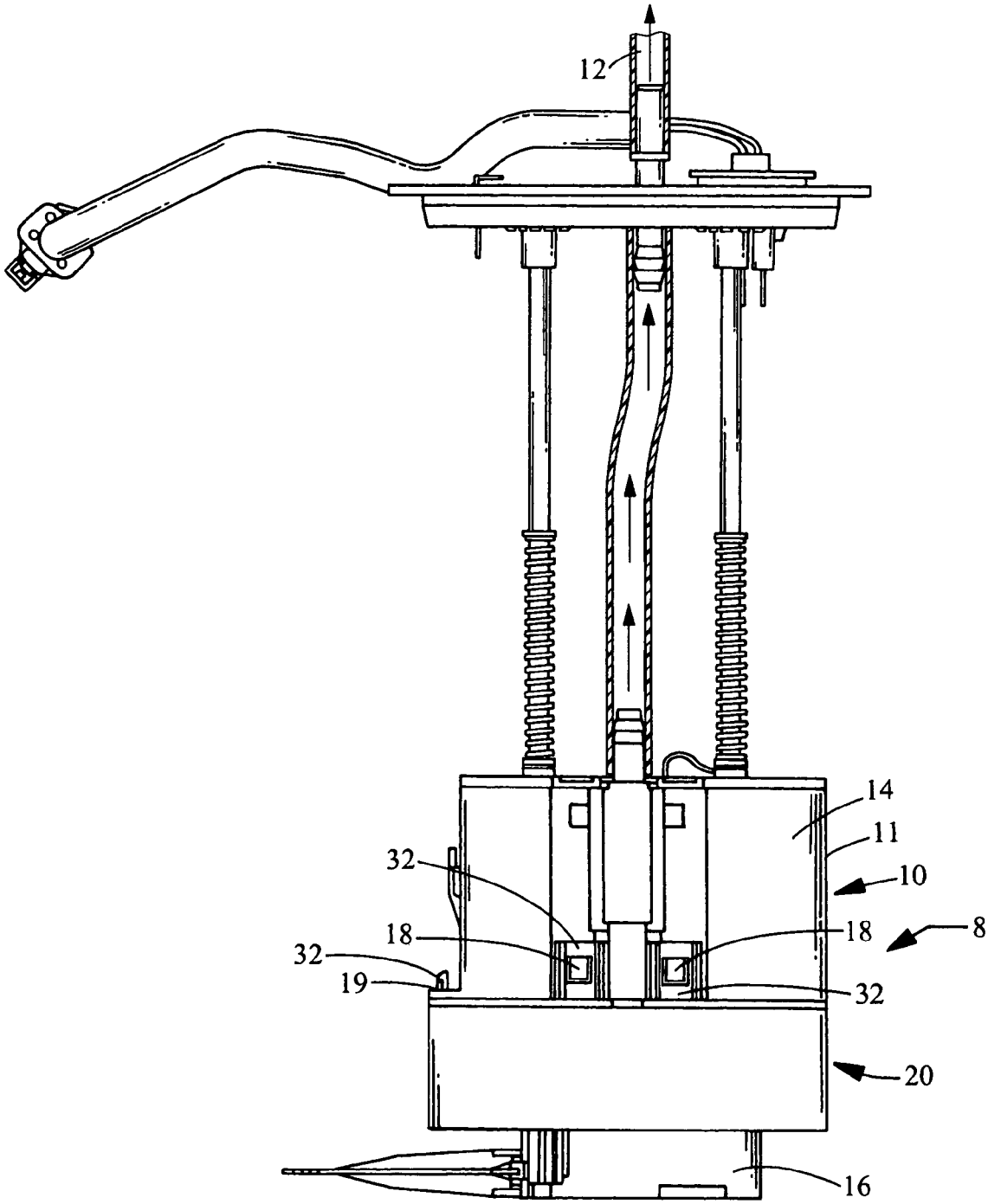
FIG. 1 is a plan view of a fuel supply system constructed in accordance with the teachings of the present invention.

Turning now to the figures, FIG. 1 depicts a front view of a fuel delivery system 8 constructed in accordance with the teachings of the present invention. The fuel supply system 8 generally includes a fuel delivery module 10 and a fuel filter 20 connected thereto. The fuel supply system 8 provides pressurized fuel to a fuel line 12 leading to the engine of a vehicle. The fuel delivery module 10 includes a housing 11 defining a reservoir for maintaining a collection of fuel for use by a fuel pump 70 (FIG. 5) to supply pressurized fuel to the fuel line 12 and engine. The fuel delivery module 10 generally includes an upper portion 14 and a lower portion 16. The lower portion 16 has a smaller outer diameter than the upper portion 14, and is sized to receive the fuel filter 20 about its periphery. The filter 20 includes a number of deflectable tabs 32 which releasably engage various projections 18 or apertures 19 formed in the fuel delivery module 10. It will be recognized that numerous types of connection features can be employed to attach the fuel filter 20 to the fuel delivery module 10.

Figure 2:
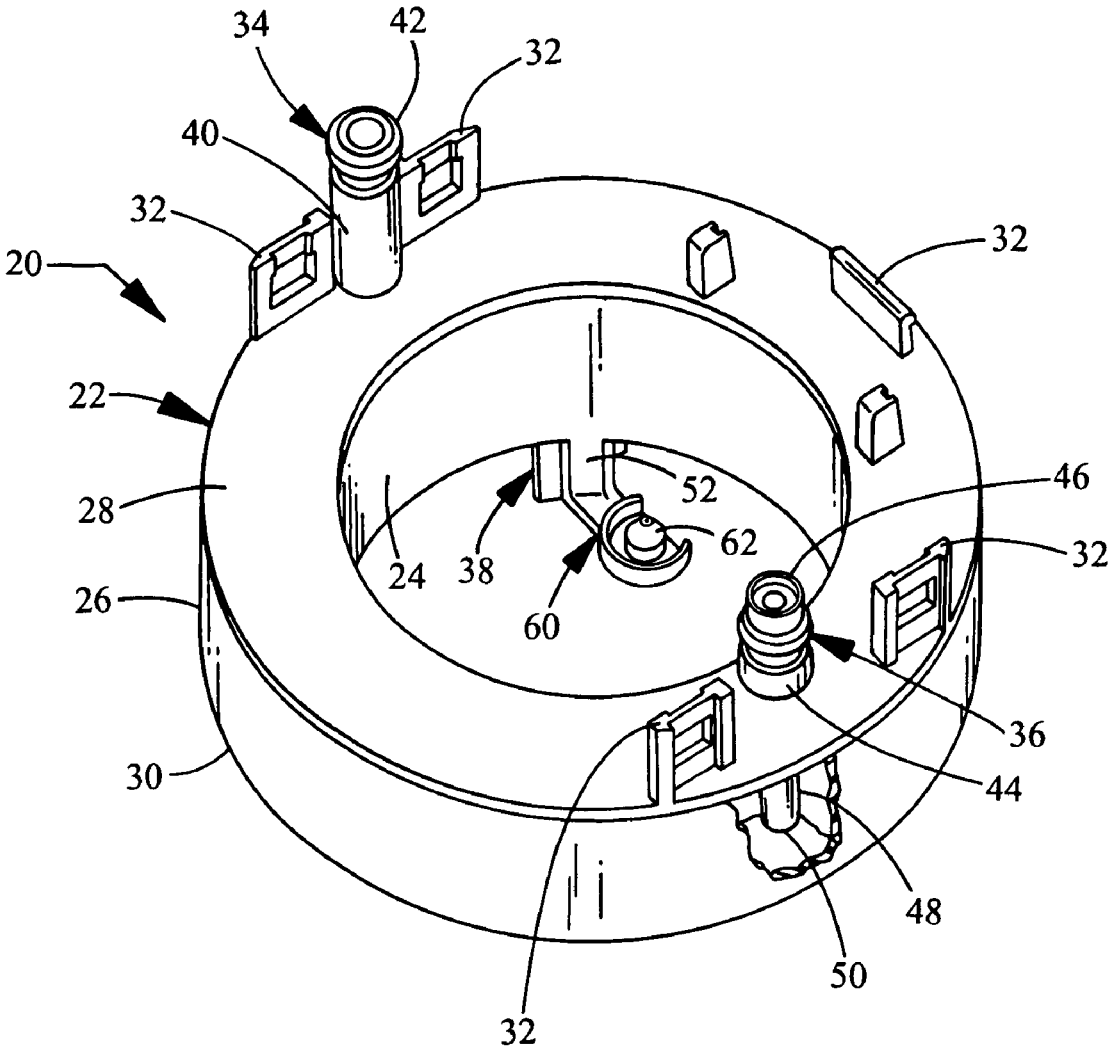
FIG. 2 is a perspective view, taken from the top, of a fuel filter forming a portion of the fuel supply system depicted in FIG. 1.
Figure 3:
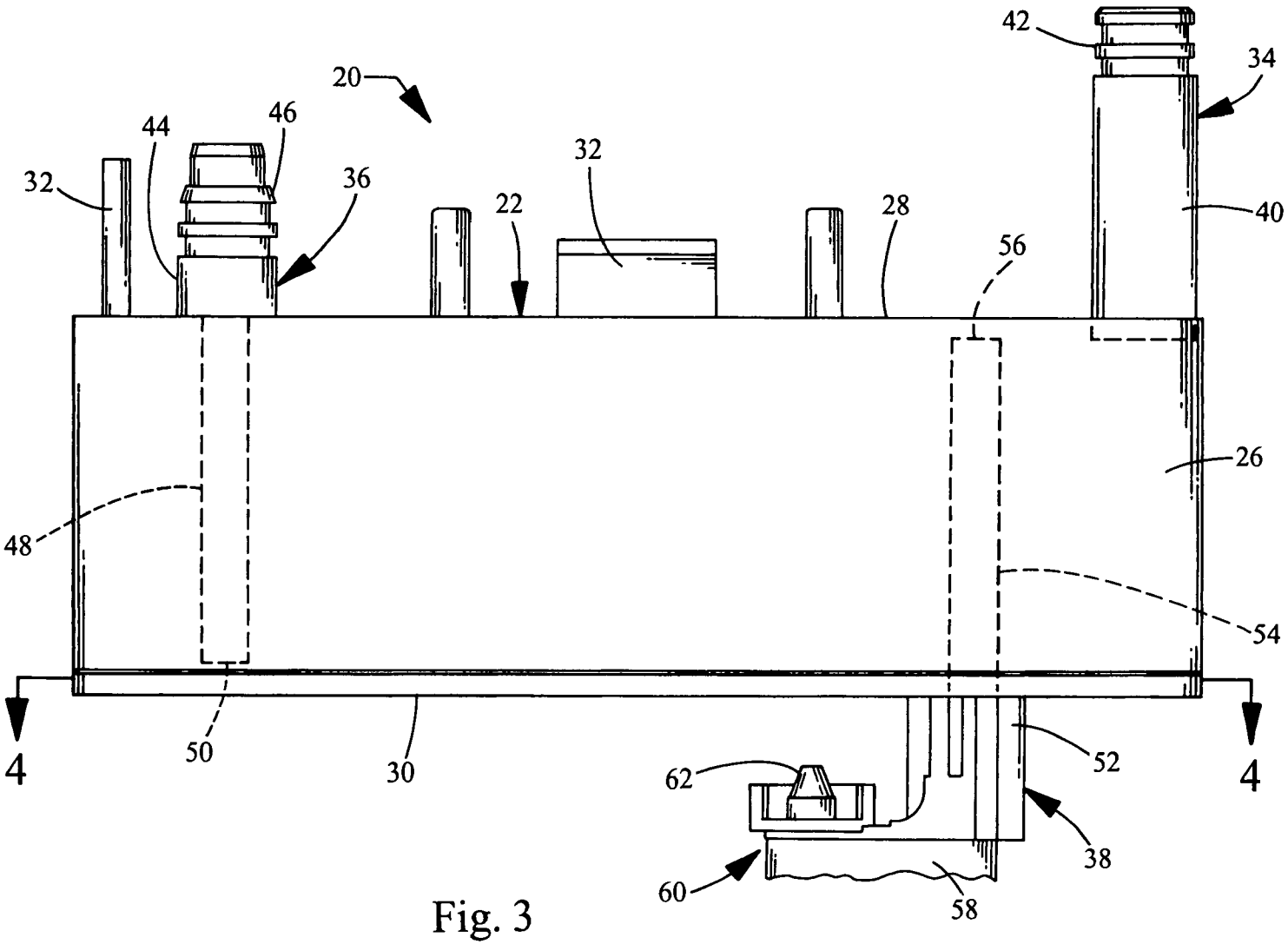
FIG. 3 is a side view of the fuel filter depicted in FIG. 2.

Turning now to FIGS. 2 and 3, FIG. 2 depicts a perspective view of the fuel filter 20 and FIG. 3 depicts a side view of the filter 20. The filter 20 includes a housing 22 defining an internal chamber 23 (FIG. 4) for filtering fuel. The filter housing 22 is preferably constructed of an electrically conductive plastic for electric static discharge. The housing 22 generally comprises an inner annular wall 24 and an outer annular wall 26. The inner and outer walls 24, 26 are connected by an upper wall 28 and a lower wall 30. A filtering media (not shown) is disposed within the chamber 23 for filtering fuel supplied to the vehicle's engine. The filter media is chosen based on OEM requirements, but is preferably constructed of paper to achieve high capacity and retention of small particle contaminants.

The filter 20 includes an inlet 34 generally comprising a standpipe 40. The distal end 42 of the standpipe 40 defines connection features for connecting the inlet 34 to an outlet of the fuel pump 70 on the fuel delivery module 10. Suffice it to say that the inlet 34 receives pressurized fuel from the fuel pump 70 and fuel delivery module 10. The inlet 34 is located on the outer periphery of the housing 22, and hence the outer periphery of the internal chamber 23. Fuel flows through the filtering media toward the inner wall 24 of the filter housing 22.

Uniquely, the fuel filter 20 includes two outlets 36, 38 located adjacent the inner wall 24 on the inner periphery of the chamber 23 for receiving filtered fuel. The first outlet 36 generally includes a standpipe 44 extending from outside the housing 22 to the interior chamber 23. The free end 36 of standpipe 44 extends outside upper wall 28 of the filter housing 20 generally includes connection features for fluidically connecting the first outlet 36 to the fuel supply 12 and engine. The standpipe 44 includes an internal portion 48 located within the housing 22 having a receiving end 50 for taking up filtered fuel. As best seen in the side view of FIG. 3, the internal standpipe 48 has its receiving end 50 located in the bottom half of the filter 20 and its housing 22. More specifically, the receiving end 50 is positioned adjacent the bottom of the filter housing 22 and proximate to the lower wall 30. In this way, filtered fuel will be pulled from the bottom of the filter 20, eliminating the potential for air pockets to enter the fuel supply line 12.

The second outlet 38 generally includes a standpipe 52 extending out of the bottom wall 30 of the filter housing 22. As best seen in FIG. 3, the standpipe 52 generally includes an internal portion 54 which is located within the internal chamber 23. The internal portion 54 of standpipe 52 includes a receiving end 56 positioned within the top half of the filter 20 and its housing 22. More specifically, the receiving end 56 is positioned adjacent the top of the filter housing 22 and proximate to the upper wall 28.

The opposing end of the standpipe 52 is fluidically connected to a jet pump 60 via a conduit 58. The jet pump 60 generally includes a nozzle 62 defining a Venturi restriction which sprays fuel into a standpipe 74 (FIG. 5) of the fuel delivery module 10. As is known in the art, the jet pump 60 and its nozzle 62 draws fuel in from the bottom of the fuel tank with a vacuum created by the velocity of fuel flowing out of the nozzle 62. Thus the jet pump 60 collects fuel when the level in the tank is low, and provides that fuel to the reservoir defined by the housing 11 of the fuel delivery module 10. By positioning of the receiving end 56, any air pockets will be forced to be released through the jet pump 60 thereby eliminating any potential adverse effect on drivability. The jet pump 60 is preferably integrally formed with the fuel filter 20 and its housing 22. Additionally, the jet pump 60 is provided with filtered fuel further increasing its efficiency and durability.

Figure 4:
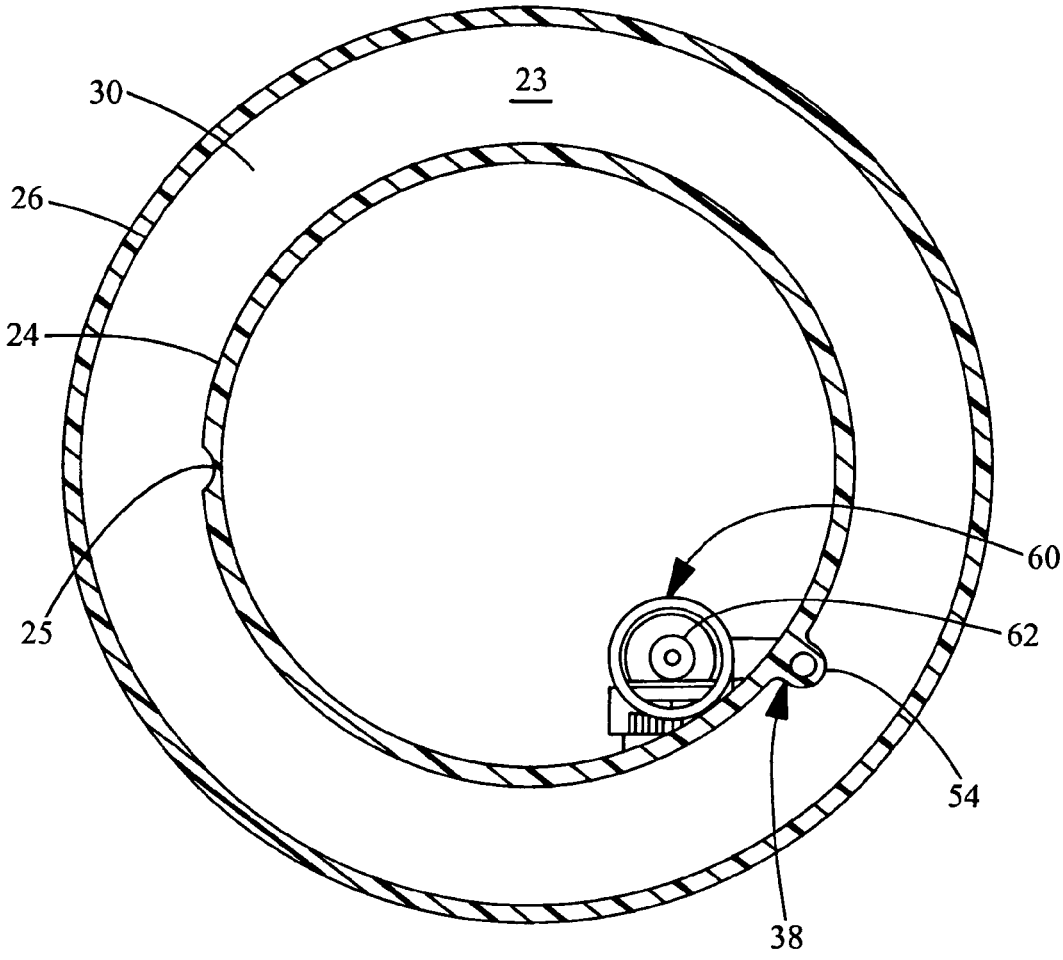
FIG. 4 is a cross-sectional view about the line 4—4 of FIG. 3.

As best seen in the cross-sectional view of FIG. 4, the jet pump 60 is located radially inside the filter 20, i.e., inside the inner wall 24. The inward location of the second outlet 38 and the internal portion 54 of its standpipe 52 can be appreciated. It can also be seen that the inner wall 24 includes a clearance or depression 25 which is shaped to accommodate at least a portion of the standpipe 44 of the first outlet 36. In this way, the space for the filtering media is enhanced and the standpipes 44, 52 do not adversely interfere with the filtering media.

Figure 5:
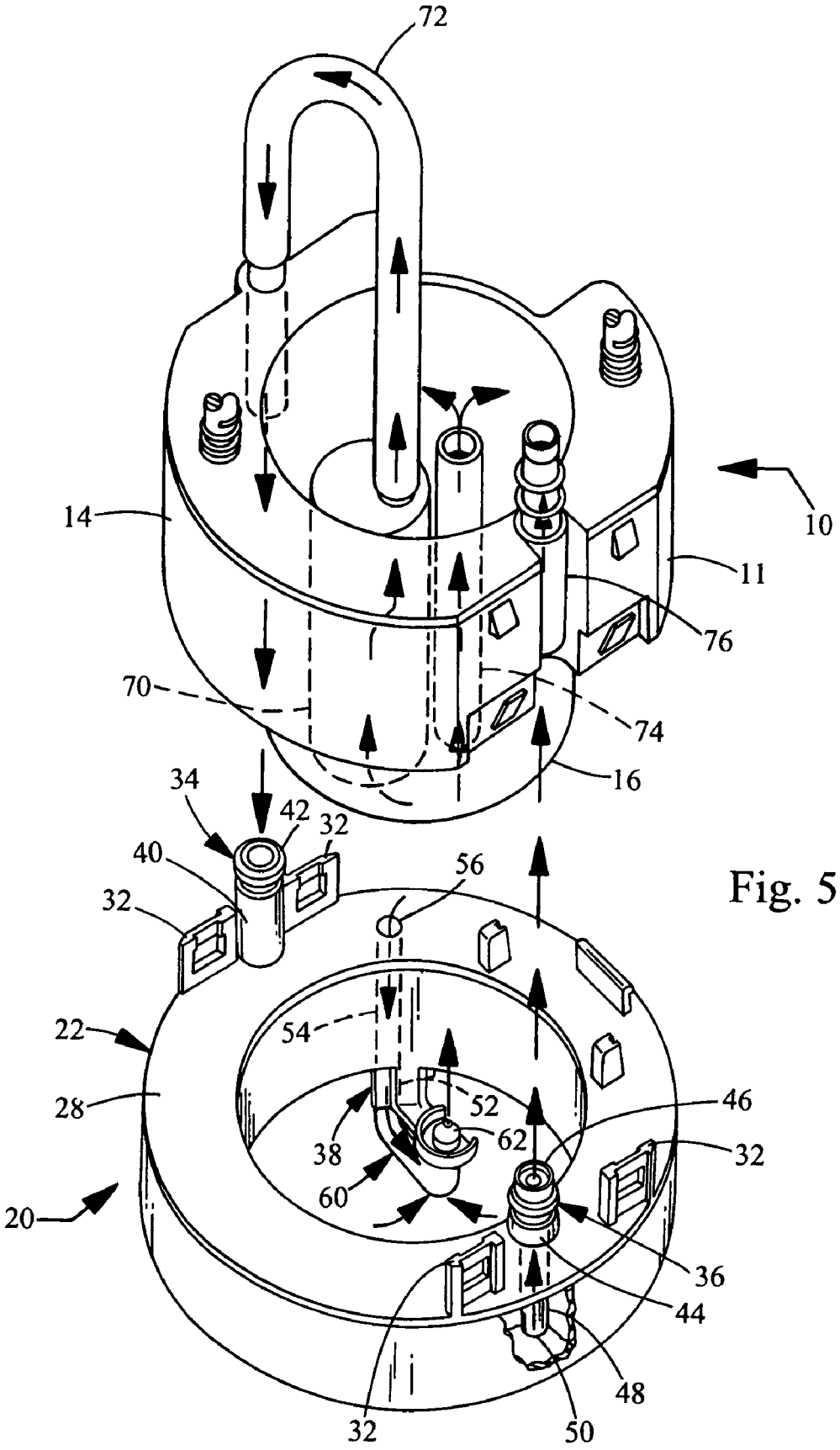
FIG. 5 is a schematic depicting the operation of the fuel supply system and fuel filter depicted in FIGS. 1–4.

The unique operation of the fuel supply system 8, and specifically the fuel filter 20, in conjunction with the fuel delivery module 10 will now be described with reference to the schematic depicted in FIG. 5. The fuel filter 20 has been shown disconnected and positioned away from the fuel delivery module 10 for purposes of illustration. Arrows have been shown to illustrate the flow of fuel through the fuel delivery module 10 and fuel filter 20. As previously discussed, the fuel delivery module 10 includes a housing 11 defining a reservoir receiving fuel from the fuel tank. The fuel delivery module 10 further includes a fuel pump 70 which provides pressurized fuel to the fuel filter 20 via a conduit 72. The conduit 72 connects to the inlet 34 via its standpipe 40 and its end 42 having quick connection features. Fuel is supplied to the outer periphery of the internal chamber 23 of the filter 20, and flows inwardly through the filtering media.

Filtered fuel is then supplied to both the first and second outlets 36, 38. The first outlet 36 includes standpipe 44 having internal portion 48 extending near the bottom of the filter 20 to a receiving end 50 which provides fuel to the engine via fuel line 12 and conduit 76 formed in the fuel delivery module 10. The second outlet 38 includes standpipe 52 having internal portion 54 extending to receiving end 56 located at the top of the filter 20 for providing fuel to the jet pump 60. As previously discussed, the jet pump 60 sprays through its nozzle 62 at high velocity to draw fuel from the bottom of the fuel tank and supplies the fuel to conduit 74 within the fuel delivery module 10. Conduit 74 allows the fuel to flow into the reservoir defined by housing 11.

By utilizing standpipes 44, 52 for the first and second outlets 36, 38, bleed down of the filter and air getting into the fuel line 12 is minimized. By locating the receiving end 56 of the second outlet 38 adjacent the top of the filter 20, the jet pump 60 will always draw fuel from a top portion of the filter. In this way, very little fuel contained within the filter 20 will be allowed to flow through standpipe 52 and jet pump 60 into the fuel tank when the vehicle is turned off. Furthermore, any air or vapors which are found within the fuel filter 20 will be purged through the jet pump 60. That is, any air or vapor within the filter 20 will be located at the top of the filter, and thus will flow through the second outlet 38 and jet pump 60 and will not be supplied to the engine or fuel line 12. Additionally, the second outlet 36 obtains fuel from receiving end 50 located at the bottom of the filter 20, thereby ensuring a solid supply of fuel for passage to the engine.

The foregoing description of various embodiments of the invention has been presented for purposes of illustration and description. It is not intended to be exhaustive or to limit the invention to the precise embodiments disclosed. Numerous modifications or variations are possible in light of the above teachings. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

The invention claimed is:

1. A fuel supply system for a vehicle having an engine, the system comprising:

a fuel tank for containing fuel;

a fuel delivery module having a reservoir and a fuel pump pressurizing fuel from the reservoir;

a fuel supply line leading from the fuel tank to the engine;

a jet pump for collecting fuel from the bottom of the fuel tank and supply the collected fuel to the reservoir;

a filter having a housing enclosing a filter media, the filter including an inlet for receiving fuel from the fuel pump, the filter including two separate fluidic outlet pathways including a first outlet supplying filtered fuel to the fuel supply line and a second outlet supplying filtered fuel to the jet pump.

2. The system of claim 1, wherein the second outlet includes a standpipe having a receiving end positioned within the top half of the filter housing.

3. The system of claim 2, wherein the receiving end is positioned adjacent the top of the filter housing.

4. The system of claim 2, wherein the filter housing includes an upper wall and a lower wall, and wherein the receiving end is positioned adjacent the upper wall.

5. The system of claim 2, wherein the filter housing includes an inner wall and an outer wall joined by an upper wall and a lower wall, and wherein one of the inner and outer walls includes a recessed channel receiving at least a portion of the standpipe.

6. The system of claim 1, wherein the first outlet includes a standpipe having a receiving end positioned within the bottom half of the filter housing.

7. The system of claim 6, wherein the receiving end is positioned adjacent the bottom of the filter housing.

8. The system of claim 6, wherein the filter housing includes an upper wall and a lower wall, and wherein the receiving end is positioned adjacent the lower wall.

9. The system of claim 1, wherein the filter housing is ring-shaped and circumscribes a portion of the fuel delivery module.

10. The system of claim 9, wherein the filter housing includes deflectable locking tabs for engaging the fuel delivery module.

11. The system of claim 9, wherein the jet pump includes a nozzle connected to the second outlet, the nozzle positioned below the filter and radially inside the ring-shape.

12. The system of claim 1, wherein the fuel delivery module and fuel filter are located within the fuel tank.

13. An in-tank fuel filter for filtering fuel between a fuel pump and a fuel supply line leading to the engine, the filter comprising:

a housing having an upper wall and a lower wall;

a filter media enclosed within the housing;

an inlet for receiving fuel from the fuel pump;

a first outlet fluidically connected to the fuel supply line, the first outlet receiving fuel from adjacent the lower wall of the housing; and a second outlet fluidically connected to a jet pump defined by a nozzle, the second outlet receiving fuel from adjacent the upper wall of the housing.

14. The filter of claim 13, wherein the second outlet includes a standpipe having a receiving end positioned proximate the upper wall of the housing.

15. The filter of claim 13, wherein the first outlet includes a standpipe having a receiving end positioned proximate the lower wall of the housing.

16. The system of claim 1, wherein the first and second outlets are positioned inside the housing.

* * * * *